US006506990B2

(12) United States Patent
Marin-Pache et al.

(10) Patent No.: US 6,506,990 B2
(45) Date of Patent: Jan. 14, 2003

(54) MULTIPOLE ELECTRICAL SWITCHGEAR APPARATUS EQUIPPED WITH A DRIVE MECHANISM AND BREAKING MODULES

(75) Inventors: Reynald Marin-Pache, Biviers (FR); Thierry Milan, Grenoble (FR); Denis Perrin, St Nicolas de Macherin (FR)

(73) Assignee: Schneider Electric Industries SA (FR)

( * ) Notice: Subject to any disclaimer, the term of this patent is extended or adjusted under 35 U.S.C. 154(b) by 15 days.

(21) Appl. No.: 09/794,345

(22) Filed: Feb. 28, 2001

(65) Prior Publication Data

US 2001/0025776 A1 Oct. 4, 2001

(30) Foreign Application Priority Data

Mar. 31, 2000 (FR) ..... 00 04162

(51) Int. Cl.[7] ..... H01H 5/00
(52) U.S. Cl. ..... 200/400; 200/401
(58) Field of Search ..... 200/400, 401, 200/48 V, 48 R, 248, 251; 218/2, 7, 14, 43, 84, 68, 78, 71, 5, 8, 44, 118, 119, 120, 152–154, 140

(56) References Cited

U.S. PATENT DOCUMENTS 4,168,414 A * 9/1979 Kumbera et al. ..... 200/153 G
5,015,809 A 5/1991 Wuthrich
5,069,077 A 12/1991 Rudolph et al.
5,175,403 A 12/1992 Hamm et al.
5,444,201 A * 8/1995 Schulman et al. ..... 218/118
5,852,266 A * 12/1998 Komuro et al. ..... 218/119
6,259,051 B1 * 7/2001 Tanimizu et al. ..... 218/120
6,373,675 B1 * 4/2002 Yamazaki et al. ..... 361/135

FOREIGN PATENT DOCUMENTS

EP 0 346 603 12/1989

* cited by examiner

*Primary Examiner*—Elvin Enad
*Assistant Examiner*—Lisa N. Klaus
(74) *Attorney, Agent, or Firm*—Parkhurst & Wendel, L.L.P.

(57) ABSTRACT

A multipole electrical switchgear apparatus comprises a drive mechanism equipped with a pole shaft and a plurality of breaking modules. Each module comprises a vacuum cartridge moved by a movable rod articulated on a transmission lever. The pole shaft is linked to the transmission levers by means of a connecting rod. This common connecting rod gives the kinematic transmission system a great strength. Furthermore, it enables switchgear apparatuses having variable distances between breaking modules to be produced inexpensively, based on a standard pole shaft. Finally, it enables differentiation of the switchgear apparatuses to be delayed.

11 Claims, 4 Drawing Sheets

MULTIPOLE ELECTRICAL SWITCHGEAR APPARATUS EQUIPPED WITH A DRIVE MECHANISM AND BREAKING MODULES

BACKGROUND OF THE INVENTION

The invention relates to a multipole electrical switchgear apparatus, and in particular to a multipole switchgear apparatus comprising vacuum cartridges.

The document EP 0,346,603 describes a three-pole electrical switchgear apparatus comprising three identical polar breaking modules arranged side by side on a frame. Each module comprises a vacuum cartridge equipped with an operating rod movable in translation. A spring-loaded drive mechanism of known type comprising a pole shaft drives the operating rods of the three vacuum cartridges. Each operating rod is connected to the pole shaft by means of an independent connecting rod system proper to the corresponding breaking module. This connecting rod system is composed of a transmission lever arranged between two connecting rods, one of the connecting rods connecting the lever to a crank of the pole shaft and the other connecting rod connecting the lever to the operating rod of the vacuum cartridge. In practice, the vacuum cartridges of the different poles are liable to be subjected to different forces when either opening or closing takes place. When opening takes place, the contacts of a cartridge may be slightly welded, or on the contrary the electromagnetic forces induced by the currents on the contacts may tend to separate the contacts of one of the cartridges more violently. When closing takes place, in particular if it takes place on a short-circuit for one of the poles, one of the contacts may be subjected to very strong repulsion forces. On account of these different stresses on the rods of the vacuum cartridges of the different poles, the pole shaft is subjected to high torsion stresses, directly transmitted by the independent connecting rod systems of the different poles. There is then a risk of large dynamic torsional strain of the pole shaft, resulting in non-simultaneous closing or opening of the different cartridges. To counteract this risk, the pole shaft then has to be over-dimensioned so as to give it an additional torsional strength. Moreover, the switchgear apparatus does not enable the distance between the vacuum cartridges of the different poles to be easily varied. It is true that construction in identical and independent breaking modules would theoretically allow any arbitrary arrangement. However, a different pole shaft corresponds to each distance between poles, since the cranks of the pole shaft have to be spaced the same distance from one another as the cartridges. The pole shaft happens to be a particularly expensive part, all the more so as its torsional strength is critical. Furthermore, the necessity of providing different pole shafts for each distance between axes makes it impossible to design the mechanism as a functional unit pre-assembled in the plant independently from the breaking modules. The architecture hardly favors delayed differentiation of the different models of a switchgear apparatus range.

OBJECT OF THE INVENTION

One object of the invention is to achieve a multipole electrical switchgear apparatus with independent polar breaking modules enabling simultaneous operation of the different modules. Another objective is to increase the modularity of a multipole switchgear apparatus with independent polar breaking modules, enabling the distance between poles to be changed at low cost. Another objective is to obtain an architecture enabling standardized functional sub-assemblies to be stocked and assembled at the last moment to meet the customer's requirements.

According to the invention, these objectives are achieved by means of a multipole electrical switchgear apparatus comprising:

- a support;
- a drive mechanism equipped with a pole shaft rotating around a first geometric axis fixed with respect to the support;
- a plurality of breaking modules, each module comprising:
  - a pair of separable contacts comprising at least one movable contact;
  - a movable rod securedly affixed to the movable contact;
  - a transmission lever pivoting around a second geometric axis parallel to the first geometric axis, said second geometric axis being common to all the breaking modules and fixed with respect to the support;
  - means for connecting the transmission lever to said rod;

comprising in addition a single connecting rod connecting the pole shaft to the transmission levers of the different breaking modules, the connecting rod being articulated on the one hand on at least two coaxial cranks of the pole shaft, defining a third geometric axis of pivoting parallel to the first geometric axis, and on the other hand on pivots ensuring pivoting of each transmission lever with respect to the connecting rod around a fourth geometric axis of pivoting parallel to the first geometric axis and common to all the breaking modules.

According to one embodiment, the movable rod is, in each module, connected to the connecting rod by means of a link pivoting around a fifth geometric axis parallel to the first geometric axis. A simple and advantageous geometric arrangement is thus obtained, ensuring a geometric transmission to a pole shaft situated at the height of the vacuum cartridges, while enabling the connecting rod to work in traction when closing of the contacts takes place. Preferably, the movable rod is connected to the connecting rod, in each module, by means of a link pivoting around a fifth geometric axis. The lever effect in this configuration enables the amplitude of the movement transmitted to be reduced and the forces to be geared down, which is particularly favorable when the contacts only have a small opening and closing travel, as is the case in particular for vacuum cartridges.

Preferably, the connecting rod is arranged to be under tension when closing takes place. Closing is the sequence of movement where the forces transmitted by the connecting rod are the greatest. By making the connecting rod work in tension in this sequence, the strains on the connecting rod are limited. When opening takes place, the connecting rod is under compression but the forces are relatively lower, so that the risks of deformation of the connecting rod out of its plane by buckling are avoided.

Preferably, the connecting rod comprises a metal plate shaped in such a way that its quadratic moment with respect to an axis perpendicular to a plane containing the third and fourth axes is high. The strength of the connecting rod in flexion in a plane containing the third and fourth axes enables any risk of delay on opening or closing of one of the pairs of contacts to be avoided.

According to a preferred embodiment, the connecting rod comprises a metal plate comprising two V-shaped arms, each V-shaped arm comprising a convergent end supporting a bearing for articulation with one of the cranks of the pole shaft, and a divergent end, the divergent ends of the two V-shaped arms being connected to one another by a base supporting bearings for articulation with the levers of the breaking modules.

According to one embodiment, the means for connecting the transmission lever to said movable rod comprise an insulating arm. This arrangement ensures insulation between the contacts and the mechanism which is accessible to operators.

According to one embodiment, the means for connecting the transmission lever to said movable rod comprise:

a contact pressure spring having two ends;

a first support means of a first end of the spring, securedly affixed to the lever;

a second support means of a second end of the spring, securedly affixed to the movable rod;

a mechanical connection between the first support means and the lever, performing full transmission of the movement of the lever in the closing direction and not performing transmission of the movement in the opening direction.

Preferably, each breaking module comprises a frame equipped with support bearings enabling pivoting of the transmission lever around the second axis of pivoting. The breaking modules can then be pre-assembled and tested in the plant before being assembled with the mechanism and connecting rod. This contributes to improving delayed differentiation.

Preferably, the connecting rod makes an angle close to a right angle with the transmission levers, and the movable rods work in translation in a plane appreciably parallel to the connecting rod. In other words, the geometric plane defined by the second and fourth geometric axes on the one hand and the geometric plane defined by the third and fourth geometric axes on the other hand make an angle of close to 90° between them, whereas the movable rod is parallel to the plane containing the third and fourth axes.

The invention is particularly well suited to a configuration wherein each breaking module comprises a vacuum cartridge forming an enclosure housing the separable contacts. However, it could be adapted to other breaking principles, provided that the opening and closing travel of the contacts is small.

BRIEF DESCRIPTION OF THE DRAWINGS

Other advantages and features will become more clearly apparent from the following description of a particular embodiment of the invention, given for non-restrictive example purposes only and represented in the accompanying drawings in which.

DETAILED DESCRIPTION OF THE PREFERRED EMBODIMENT

Figure 1:
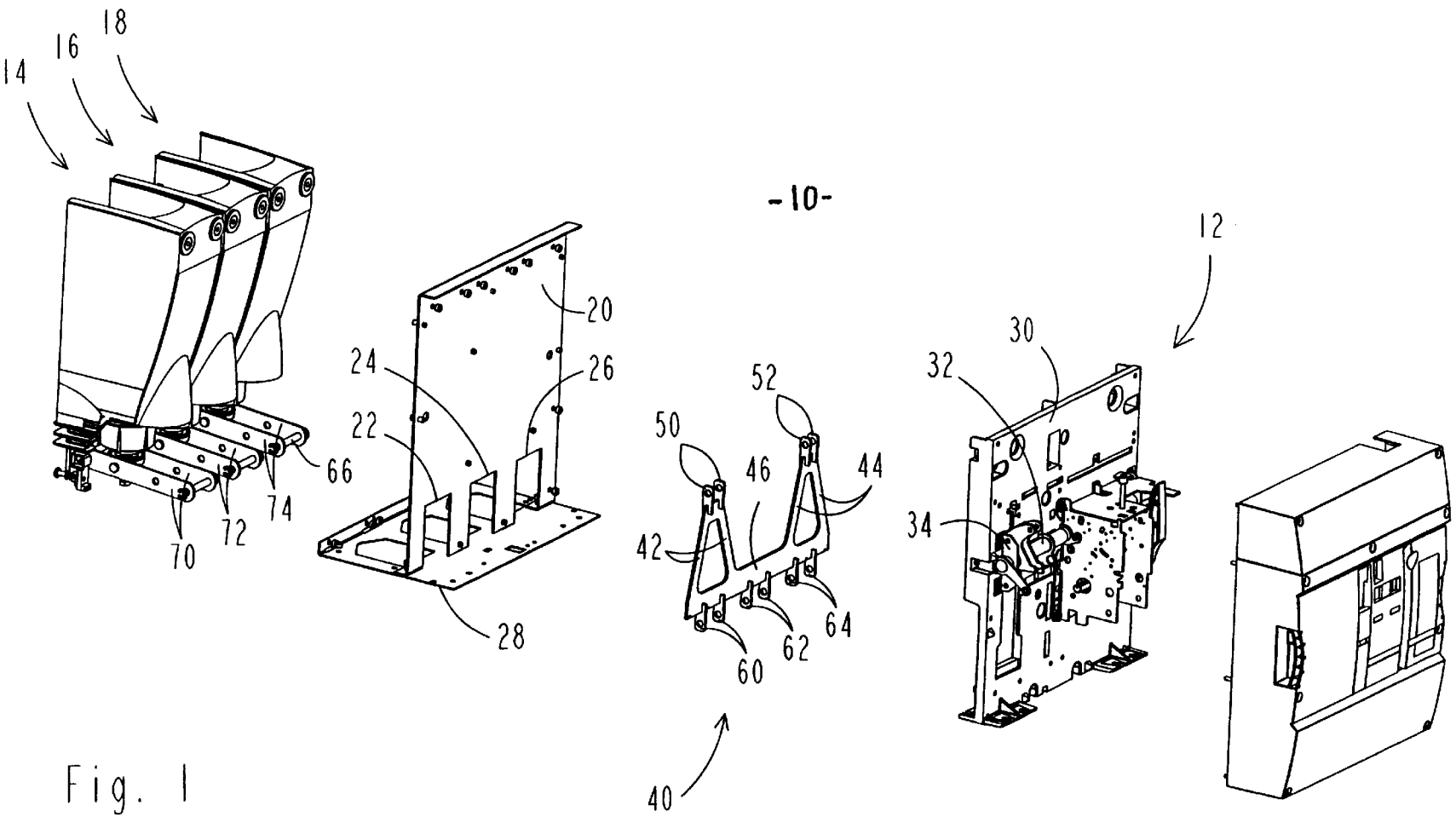
FIG. 1 represents an exploded view of a switchgear apparatus according to an embodiment of the invention, showing in particular a drive mechanism and breaking modules.
Figure 2:
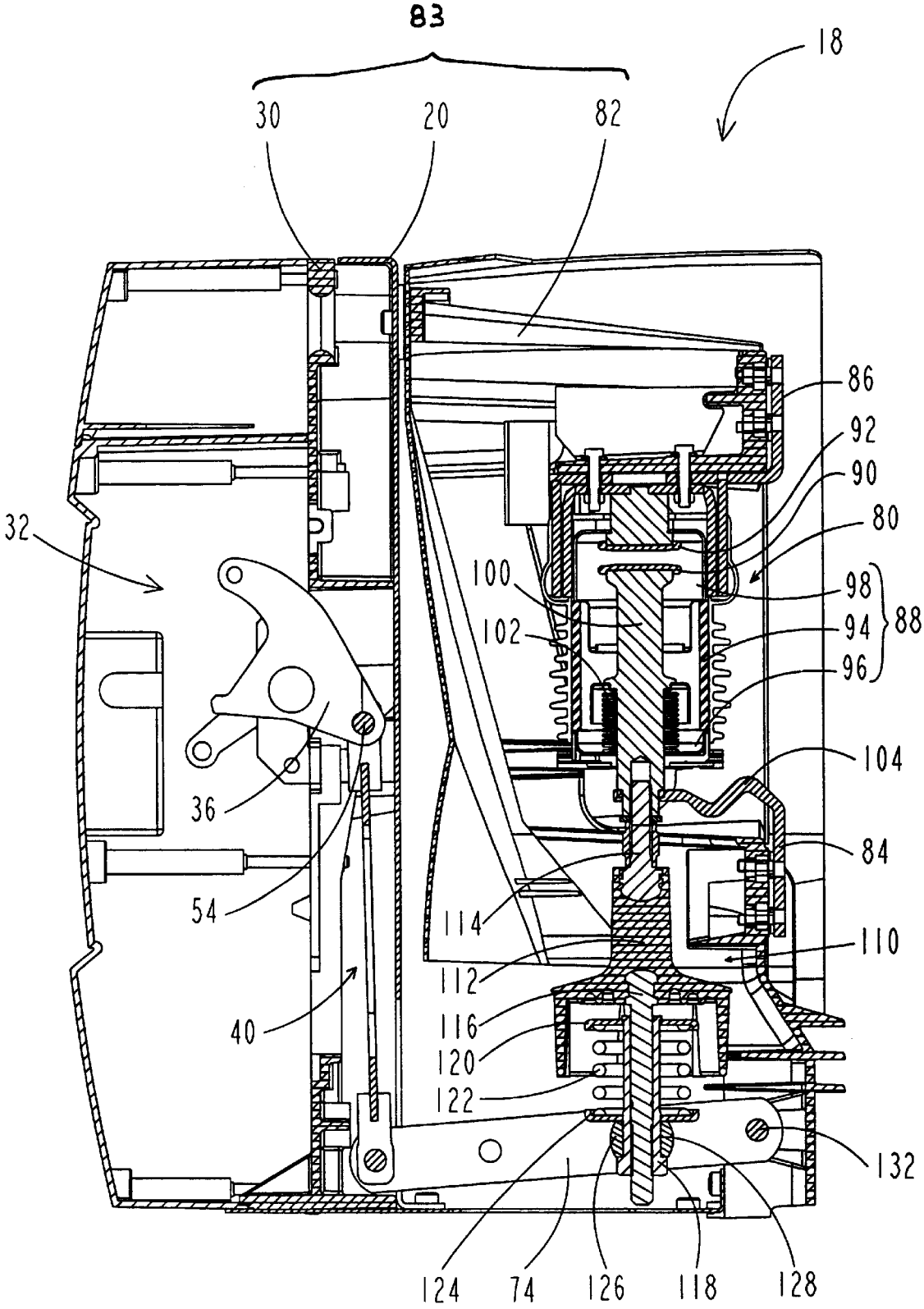
FIG. 2 represents a cross-sectional view of the switchgear apparatus of FIG. 1, in the open position.

With reference to FIGS. 1 and 2, a three-pole switchgear apparatus 10 comprises a drive mechanism 12 and three identical breaking modules 14, 16, 18, arranged side by side on the same side of a partition 20 separating the modules from the drive mechanism 12. The partition 20 is formed by a metal plate having three windows 22, 24, 26 and is supported by a second metal plate 28 forming a bracket and acting as support base. The partition 20 is at earth potential and performs electrical protection of people.

The drive mechanism 12 can be of any known type comprising a pole shaft. It can for example be a mechanism of the type described in the document EP-A-0,222,645, equipped with a loading and closing sub-assembly comprising a closing spring, and with an opening sub-assembly comprising an opening spring. The essential thing with respect to the present invention is that the mechanism comprises an output shaft, which can also be called pole shaft. In the embodiment, the mechanism 12 is fixed to a support frame 30 and equipped with a pole shaft 32 supported by bearings 34 fixed to the frame 30. The frame is itself fixed to the partition 20.

Figure 3:
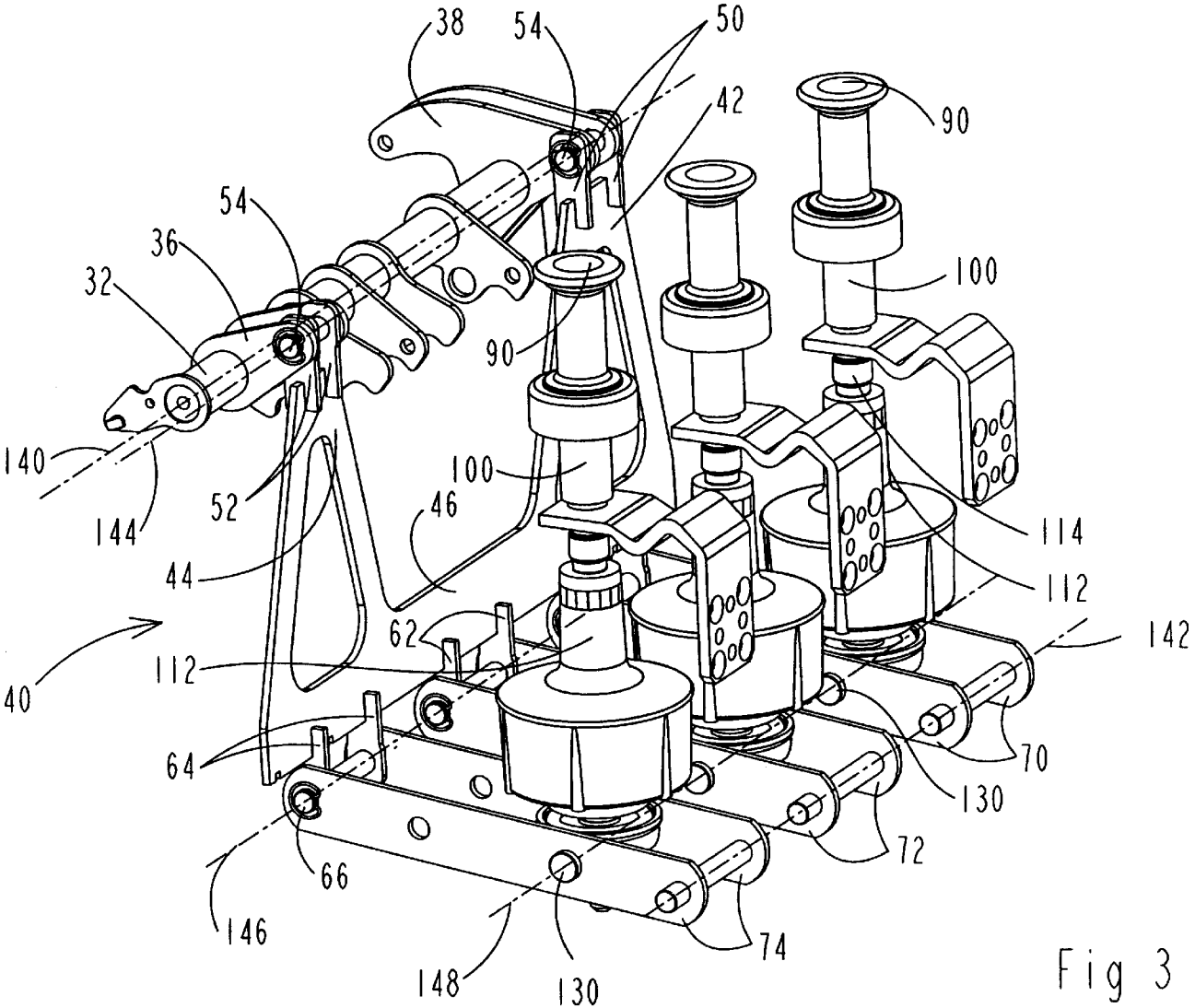
FIG. 3 represents a perspective view of a kinematic transmission system connecting the mechanism to the breaking modules.

As illustrated in FIG. 3, the pole shaft 32 comprises two double cranks 36, 38 which pass through the wall of the frame via apertures and enable articulation to be achieved between the pole shaft 32 and a transmission rod 40. The transmission rod 40 is formed by a flat part forming two double V-shaped arms 42, 44, spaced apart from one another and joined at their divergent ends by a base 46. Each V-shaped arm 42, 44 supports, at its convergent end, a pair of flanges 50, 52 provided with coaxial bores, forming bearings. The cranks 36, 38 also comprise coaxial bores forming bearings, so that a pivoting link of the hinge type is obtained between the double cranks 36, 38 of the pole shaft 32 and the transmission rod 40 by insertion of spindles 54 in the corresponding bores of the double cranks 36, 38 and of the double flanges 50, 52. The base 46 supports three pairs of flanges 60, 62, 64 provided with coaxial bores, forming bearings. By insertion of spindles 66, these flanges enable a hinge type link to be achieved with three double levers 70, 72, 74 belonging to the three polar modules 14, 16, 18 of the apparatus and passing through the windows 22, 24, 26 of the partition 20.

As the three breaking modules are identical, only the module 18 will be described. As illustrated in FIG. 2, the module 18 comprises a vacuum cartridge 80 supported by a frame 82. The frame 82 is fixed to the wall 20 and to the support base 28, so that the frame 30, partition 20, the metal plate 28 and the frames 82 of the three poles together form a support assembly 83 for the other parts of the apparatus. Two connecting strips 84, 86, fixed to the frame 82, are designed to electrically connect the cartridge 80 to a busbar (not represented). The generic expression 'vacuum cartridge' designates in this case a sub-assembly of known type comprising a cylindrical body 88 forming an enclosure wherein a relative vacuum prevails and which houses a pair of separable contacts 90, 92 connected to the connecting strips 84, 86. The body 88 is itself divided into a central insulating section 94 made of insulating material, a first metallic end section constituting a first closing flange 96, and a second metallic end section constituting a second closing flange 98. The contact 92 is stationary and is connected to the second flange 98. The other contact 90 forms an axial end of a rod 100 movable in translation along its axis and passing through the body 88 of the cartridge via an orifice of the flange 96. A sealing bellows 102 brazed onto the rod 100 and onto the internal wall of the first flange 96 allows an axial movement of the rod 100 and of the movable contact 90 in translation with respect to the stationary contact 92, while preserving the vacuum prevailing in the enclosure. Electrical connection of the rod 100 to the busbar is achieved by means of a flexible electrical connection 104, one of the ends of this connection also constituting the connecting strip 84.

Outside the enclosure, the rod 100 is connected to the double lever 74 by means of an insulating arm 110. The insulating arm comprises a body made of plastic material 112 overmolding on the one hand the head of a first threaded rod 114, and on the other hand the head of a second threaded rod 116 situated in the axial extension of the first rod 114. The first threaded rod 114 is screwed into a tapped blind hole situated at the end of the rod 100 of the cartridge 80. A tubular adjusting nut 118 is screwed onto the second threaded rod 116. The nut 118 supports at one end a support seat 120 for one end of a contact pressure spring 122. The other end of the spring 122 bears on a second support seat 124, which rests on a bar 126. The bar comprises a bore 128 forming a guide sheath through which the tubular nut 118 passes. The bar 126 rotates freely in the lateral spindles 130 supported by the arms of the lever 74. The guide sheath 128 allows both translation of the nut 118 parallel to its axis and free rotation thereof. The nut 118 comprises a shoulder resting on the bar part 126 opposite the second support seat 124. The two arms of the double lever 74 pivot around a spindle 132 supported by the frame 82. The three breaking modules 14, 16, 18 of the apparatus 10 being arranged side by side, the pivoting spindles 132 of the levers 70, 72, 74 are aligned and parallel to the pole shaft 32. The levers 70, 72, 74 are parallel.

The kinematic system connecting the pole shaft 32 to the rods 100 of the three breaking modules 14, 16, 18 thus comprises a single connecting rod 40 between the pole shaft 32 and the three double levers 70, 72, 74 of the breaking modules, and is extended in each module by an insulator 112, one of whose ends slides in a sheath 128 rotating with respect to the double lever 70, 72, 74, and the other of whose ends is secured to the rod 100 of the cartridge 80. This kinematic system enables five geometric axes of parallel rotation to be defined: a first geometric axis 140 of pivoting of the pole shaft, a second geometric axis 142 of pivoting of the levers 70, 72, 74, a third geometric axis 144 of pivoting of the connecting rod with respect to the cranks of the pole shaft, a fourth geometric axis 146 of pivoting of the connecting rod with respect to the levers, and a fifth geometric axis 148 of pivoting of the bars 126 with respect to the levers 70, 72, 74. The first axis 140 and the second axis 142 are both fixed with respect to the support 83, the other axes being mobile during the opening and closing sequences.

Strictly speaking, the movement imparted on the rod 100 of the cartridge 80 by this mechanism without any play between the moving parts would not be perfectly straight with respect to the frame 82. However, the angle between the lever 70, 72, 74 and the rod 100 is always very close to a right angle, and the travel of the rod 100 of the cartridge between its open position and its closed position does not exceed a few millimeters, which corresponds to an angle of rotation of the lever not exceeding a few degrees, so that in the absence of play, the scope of radial movement of the rod 100 would be about one hundredth of its axial travel. In the embodiment described, this radial movement is absorbed by the clearances existing between the various elements of the kinematic system, in particular at the level of the spindles 130, 132. However, if a larger travel was desired, it would be possible to guide the bar 126 in an oblong of the lever 90, 92, 94.

Figure 4:
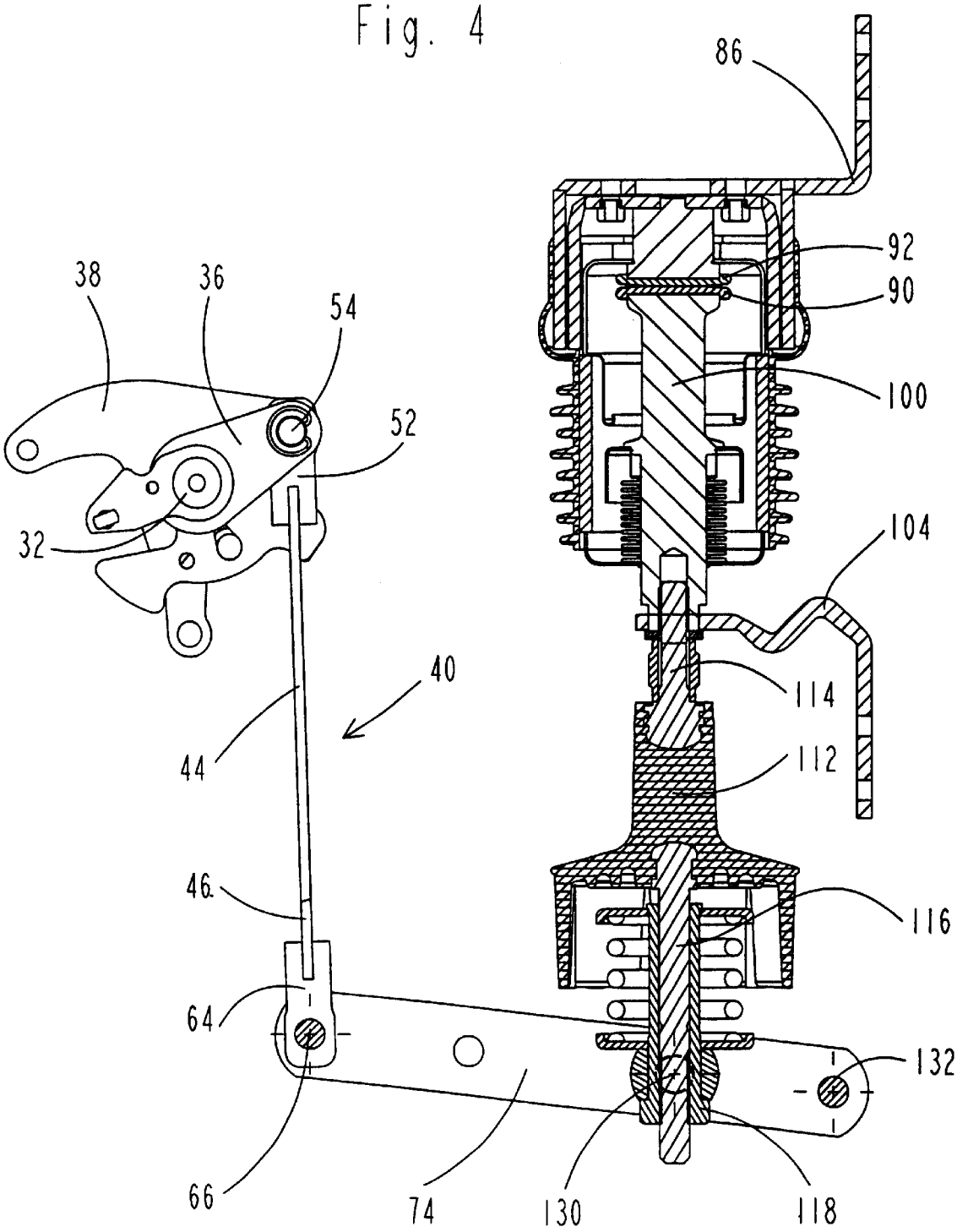
FIG. 4 represents a side view of the kinematic system, in the closed position.

The kinematic system operates in the following manner. When the contacts are separated and the mechanism is open, the kinematic system is initially in the position represented in FIG. 2. When closing takes place, the closing spring of the mechanism 12 drives the pole shaft 32 counterclockwise over a travel of more than 50°. The connecting rod 40 transmits this movement uniformly to the three double levers 70, 72, 74. In each of the breaking modules, the double lever pivots clockwise around the spindle 132, driving the bar 126 which compresses the spring 122 by means of the support seat 124. The closing force is then transmitted by the spring 122 to the movable contact 90 via the seat 120, the nut 118 and the insulating arm 110. The kinematic system is then in the closed position of FIG. 4, the contacts being closed.

When opening takes place, the opening spring of the mechanism 12 drives the pole shaft clockwise over a travel of more than 50°. The connecting rod 40 transmits this movement uniformly to the three double levers 70, 72, 74. In each of the breaking modules, the double lever pivots counterclockwise around the spindle 132 in FIG. 4, directly driving the bar 126, the nut 118, the insulating arm 110 and the rod 100 of the movable contact, until the open position of FIG. 2 is reached.

The single connecting rod 40 has a high quadratic moment with respect to an axis perpendicular to the geometric plane containing the axes of pivoting of the connecting rod with respect to the pole shaft and the double levers. Although the structure of the connecting rod has been lightened to reduce its weight, the base 46 keeps the required strength. In other words, the forces applied to the connecting rod in its plane are not liable to induce a notable flexion of the connecting rod. Consequently, the connecting rod 40 gives the kinematic system a great strength, so that even if the forces to be applied to the different cartridges are different, their movement will nevertheless be simultaneous. By construction, the pole shaft 32 itself has a very great torsional strength, so that the two hinges joining the connecting rod 40 to the pole shaft 32 can be spaced apart which contributes to increasing the strength of the kinematic system even further.

The connecting rod is manufactured by being cut out from a sheet metal plate. The levers are also made of metal plate. The electrical insulation is achieved in each breaking module by means of the insulating arms. It should be noted that the insulating part 112 of the arm is shaped as a skirt so as to achieve optimum insulation.

To modify the distance between the axes of the polar modules, the connecting rod and, if necessary, the wall 20, which are very inexpensive parts, simply have to be changed. Each specific connecting rod has a base of a different length and especially flanges 60, 62, 64 of variable number and locations. The distance between the flanges 50, 52 performing the hinge link with the cranks of the pole shaft on the other hand remains constant. The pole shaft 32 thus remains identical whatever the distance between the axes of the polar modules, which means that the mechanism 12 can be pre-assembled in the plant and forms a functional unit for the whole of the range. In like manner, the breaking modules 14, 16, 18 are identical whatever the distance between axes chosen. This enables assembly of the apparatus to be deferred until the customer has made his choice.

Various modifications are naturally possible. The number of modules is not limited to three: the invention applies equally to two-pole, four-pole, or even six-pole or eight-pole apparatuses. The levers 70, 72, 74 can be single. The drive mechanism can be of any type: with distinct closing and opening springs to enable a closing, loading, opening, closing, opening sequence; or with a single spring enabling closing and opening.

What is claimed is:

1. A multipole electrical switchgear apparatus comprising:

a support;

a drive mechanism equipped with a pole shaft for rotating around a first geometric and axis fixed with respect to the support;

a plurality of breaking modules, each module comprising:

a pair of separable contacts comprising at least one movable contact;

a movable rod securely affixed to the movable contact;

a transmission lever for pivoting around a second geometric axis parallel to the first geometric axis, said second geometric axis being common to all the breaking modules and fixed with respect to the support;

means for connecting the transmission lever to said rod; and a single connecting rod connecting the pole shaft to the transmission levers of the breaking modules, the connecting rod being articulated on at least two coaxial cranks of the pole shaft, defining a third geometric axis of pivoting parallel to the first geometric axis, and on pivots ensuring pivoting of each transmission lever with respect to the connecting rod around a fourth geometric axis of pivoting parallel to the first geometric axis and common to all the breaking modules.

2. The switchgear apparatus according to claim 1, wherein in each module, the movable rod is connected to the connecting rod by means of a link for pivoting around a fifth geometric axis parallel to the first geometric axis.

3. The switchgear apparatus according to claim 2, wherein in each module, the fifth pivot axis is located between the second axis and the fourth axis, closer to the second axis than to the fourth axis.

4. The switchgear apparatus according to claim 1, wherein the connecting rod is under tension during closing of the switchgear apparatus.

5. The switchgear apparatus according to claim 1, wherein the connecting rod comprises a metal plate having a shape with a high quadratic moment with respect to an axis perpendicular to a plane containing the third and fourth axes, so that even if the forces to be applied to the different breaking modules are different, the movement of the modules will nevertheless be simultaneous.

6. The switchgear apparatus according to claim 1, wherein the connecting rod comprises a metal plate comprising two V-shaped arms, each V-shaped arm comprising a convergent end supporting a bearing for articulation with one of the cranks of the pole shaft, and a divergent end, the divergent ends of the two V-shaped arms being connected to one another by a base supporting bearings for articulation with the levers of the breaking modules.

7. The switchgear apparatus according to claim 1, wherein the means for connecting the transmission lever to said movable rod comprise an insulating arm.

8. The switchgear apparatus according to claim 1, wherein the means for connecting the transmission lever to said movable rod comprise:

a contact pressure spring;

a first support means of a first end of the spring, securely affixed to the lever;

a second support means of a second end of the spring securely affixed to the movable rod;

a mechanical connection between the first support means and the lever, such that the first support means is secured to the lever when the lever is moved in the closing direction of the switchgear apparatus.

9. The switchgear apparatus according to claim 1, wherein each breaking module comprises a frame equipped with support bearings enabling pivoting of the transmission lever around the second pivot axis.

10. The switchgear apparatus according to claim 1, wherein the connecting rod has a shape comprising substantially a right angle with the transmission levers, and the movable rods are for moving in translation appreciably parallel to the connecting rod.

11. The switchgear apparatus according to claim 1, wherein each breaking module comprises a vacuum cartridge enclosing the separable contacts.

* * * * *